US005137246A

United States Patent [19]

Idso

[11] Patent Number: 5,137,246

[45] Date of Patent: Aug. 11, 1992

[54] ADJUSTABLE CHRISTMAS TREE STAND

[76] Inventor: Donald Idso, P.O. Box 237, Milford, Iowa 51351

[21] Appl. No.: 803,184

[22] Filed: Dec. 5, 1991

Related U.S. Application Data

[63] Continuation of Ser. No. 615,158, Nov. 19, 1990, abandoned.

[51] Int. Cl.[5] ..... A47G 33/00

[52] U.S. Cl. ..... 248/523; 248/520; 248/514; 248/142; 47/40.5

[58] Field of Search ..... 248/514, 523, 519, 520, 248/137, 574, 142, 141; 47/40.5

[56] References Cited

U.S. PATENT DOCUMENTS

| | | |
|---|---|---|
| 464,487 | 12/1891 | Allen . |
| 2,605,067 | 7/1952 | Lindsell . |
| 3,603,547 | 9/1971 | Hills . |
| 3,954,129 | 5/1976 | Rudell et al. . |
| 4,156,323 | 5/1979 | Scheffler . |
| 4,320,886 | 3/1982 | Stodola . |
| 4,436,272 | 3/1984 | Lile . |
| 4,571,882 | 2/1986 | Capen . |
| 4,801,123 | 1/1989 | Lynch . |
| 4,825,586 | 5/1989 | Coppedge . |
| 4,913,395 | 4/1990 | Juhas . |

FOREIGN PATENT DOCUMENTS

| | | |
|---|---|---|
| 120484 | 9/1926 | Switzerland . |

*Primary Examiner*—Alvin C. Chin-Shue

*Attorney, Agent, or Firm*—Zarley, McKee, Thomte, Voorhees, & Sease

[57] ABSTRACT

A stand for Christmas trees comprised of a base plate with a pair of spaced-apart upright brackets mounted thereon. The tree holder receptacle is pivotally mounted between the upright brackets so that is can move about a horizontal axis in order to orient the tree trunk to a generally vertical position. A pair of locking levers are associated with the upright brackets so that they can be releasably clamped to orient the tree holder receptacle in any desired position. A set screw is provided to accept the tree into the tree holder receptacle.

8 Claims, 1 Drawing Sheet

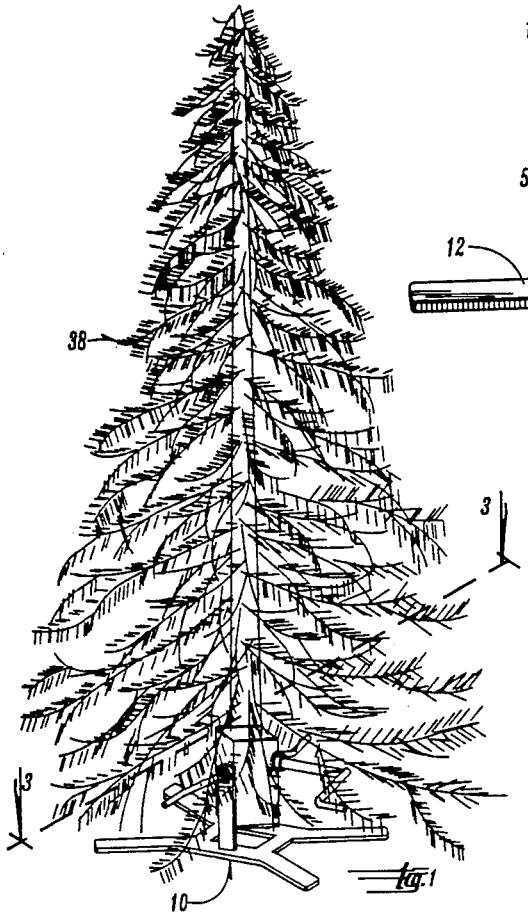
Fig. 1
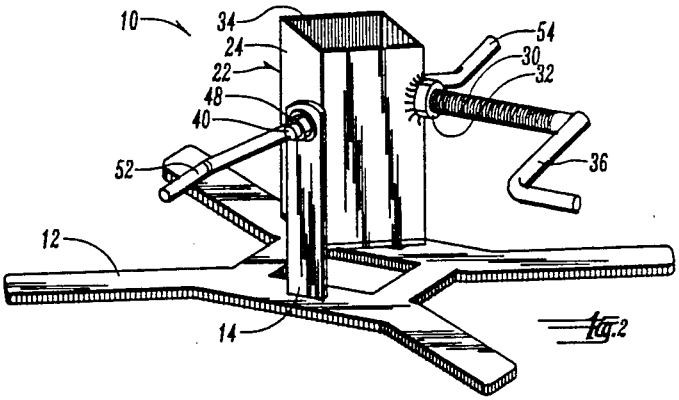
Fig. 2
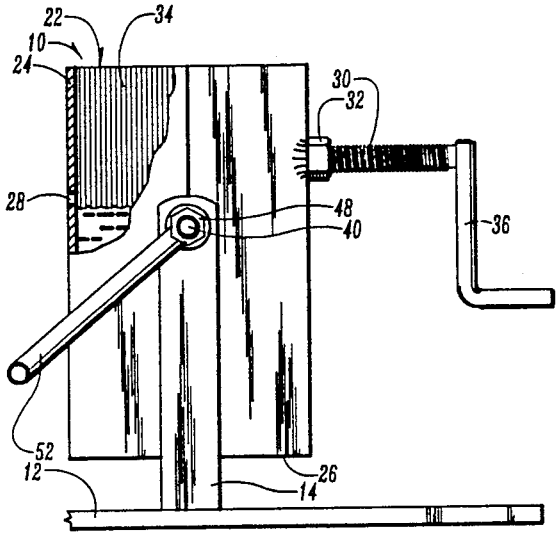
Fig. 4
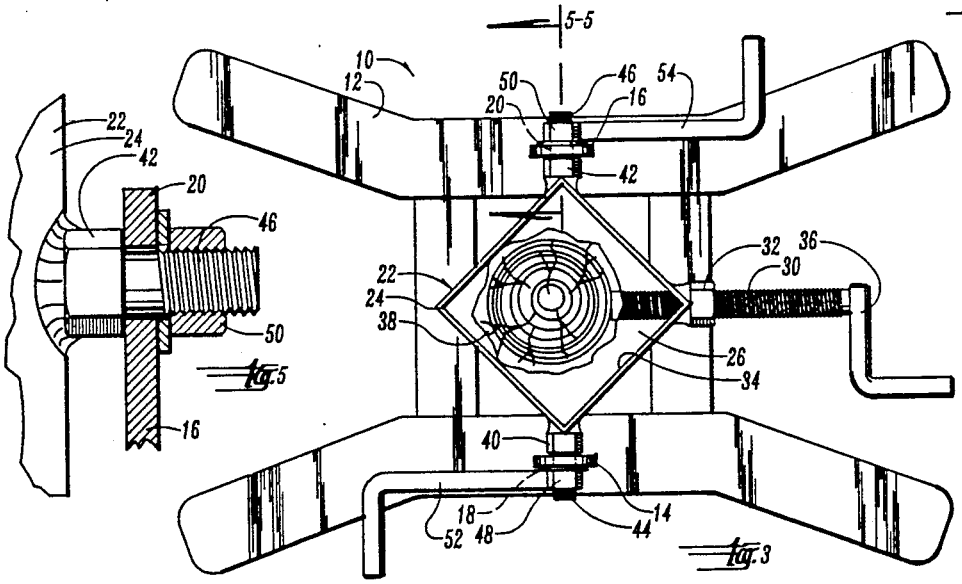
Fig. 3
Fig. 5

ADJUSTABLE CHRISTMAS TREE STAND

This is a continuation of copending application Ser. No. 615,158 filed on Nov. 19, 1990, now abandoned

BACKGROUND OF THE INVENTION

This invention relates to a Christmas tree stand holder. The holder is highly stable and is designed to solve an age-old problem, i.e. trees with crooked trunks.

It often happens that otherwise good christmas trees do not have straight trunks. Thus, the trunk of the tree may have a crook between its base or butt and its upright end. This means that orienting the butt of the tree in a typical tree stand may not necessarily orient the trunk such that it appears vertical when displayed. Such trees are often difficult to sell, and thus become wasted as unsuitable for Christmas trees.

While in the past various attempts have been made to provide adjustable tree stands to allow for compensation for crooked trunks, none of those have met with any significant degree of success. Moreover, many have the additional problem of creating instability in the tree stand once the adjustment necessary to give an appearance of straightness has been made.

It is therefore a primary objective of the present invention to provide an adjustable tree stand which allows the tree holder to be adjusted to compensate for crooked Christmas tree trunks.

Another objective of the present invention is to provide a holder which is adjustable to compensate for crooked tree trunks and yet will remain stable in use.

An even further objective of the present invention is to provide a simple structure which securely holds a Christmas tree that is easy to adjust for any person, even those of minimal mechanical skill.

The method and means of accomplishing each of these objectives as well as others will become apparent from the detailed description of the invention which follows hereinafter.

SUMMARY OF THE INVENTION

This invention relates to an improved Christmas tree stand. The stand is comprised of a base plate with a pair of spaced apart vertically oriented upright brackets mounted to the base plate. Positioned between the brackets for pivotal movement about a horizontal axis is a tree holder. The tree holder can be locked into any orientation about its pivotal axis by lock levers associated with the brackets. A set screw with an associated handle is used to lock the tree into the tree holder receptacle.

BRIEF DESCRIPTION OF THE DRAWINGS

FIG. 1 shows a tree locked in position in the tree stand of the present invention.

FIG. 2 shows a perspective view of the tree stand of the present invention.

FIG. 3 shows a plan view of the tree stand holder taken along line 3—3 of FIG. 1.

FIG. 4 shows an elevation side view with certain parts broken away of the tree stand of the present invention.

FIG. 5 shows in detail along line 5—5 how the lock levers clamp the tree holder.

DETAILED DESCRIPTION OF THE INVENTION

The tree stand referred to generally as 10 is comprised of a base plate 12 having fixedly attached thereto a pair of spaced apart upright brackets 14 and 16. Adjacent their upper ends brackets 14 and 16 each have an aperture respectively, 18 and 20. The tree holder 22 is comprised of a continuous rectangular walled vessel 24 having a bottom 26. Overflow water hole 28 appears in the wall 24. Associated with tree holder 22 is a set screw 30 which is received in a tapped bore 32 in wall 24 of tree holder 22. Set screw 30 has a clamping handle 36. Thus, a Christmas tree 38 having a trunk butt end may be received in receptacle 32 and rotated about its own vertical axis to a desired position, at which point set screw 30 can be screwed into the tree trunk by turning clamp handle 36 to fixedly secure the tree in tree holder 32.

Also attached to tree holder vessel wall 24 are a pair of ready bolts 40 and 42 with tapped bores. Ready bolts 40 and 42 have a treaded bores 44 and 46 for receipt of threaded nut 48 and 50. Threaded nuts 48 and 50 can be tightened by turning their associated handles or locking levers 52 and 54.

In actual operation, the unit works in the following manner. A Christmas tree 38 is placed in tree holder 10. It is oriented by rotation about its own vertical axis to a desired position and set screw 30 is turned into the tree via clamp handle 36. Once the tree is secured in its desired position about its own vertical axis, the tree is then oriented in order to compensate for any crook in its trunk so that it gets an appearance of being substantial vertical. This is accomplished by loosening locker lever handles 52 and 54 so that the tree holder is movable about the axis defined by the shafts of bolts 40 and 42. When the tree holder pivots about the axis defined by the shafts 44 and 46 to the desired position to give the tree a substantially straight appearance, lock levers 52 and 54 are turned and the upright brackets 14 and 16 are compresses inwardly and clamped against the tree holder, releasably locking it into a desired position. This, the tree is full adjustable, both about its vertical axis and about a pivotal defined by a center line from bolts 40 and 42 in order that it is oriented to give a maximum desired aesthetic appearance.

It therefore can be seen that the invention accomplishes all of its stated objectives.

What is claimed is:

1. A Christmas tree stand comprising:

a base having a pair of spaced apart upright brackets mounted thereon, said brackets each having an aperture therein, the base being constructed of a thin, planar plate;

tubular receptacle for receiving the trunk of a tree, and having shafts fixedly connected to and extending horizontally outwardly from opposite sides thereof, the shafts being pivotally received in the respective apertures of the brackets so as to support the receptacle for pivotal movement about a horizonal axis, the receptable having a sidewall within which the tree trunk is receivable and having a bottom wall connected to the sidewall so that the receptable is capable of holding water;

a lock lever associated with at least one of said brackets for releasably but securely locking the receptacle in a predetermined orientation needed to orient the tree in a substantially vertical position; and a single threadable securement means to releasably secure the tree in the receptacle.

2. The tree stand of claim 1 wherein the base includes a plurality of flat, horizontally disposed, diverging legs which engage a floor along their entire length.

3. The tree stand of claim 1 wherein the securement means includes a single set screw threadably extending through the receptacle and adapted to hold the tree in engagement against a portion of the sidewall of the receptacle.

4. The tree stand of claim 1 wherein the base includes a plurality of flat, horizontally disposed, diverging legs which engage a floor along their entire length.

5. The tree stand of claim 1 wherein the securement means includes a shaft threadably extending through the receptacle, and an L-shaped handle having a leg portion attached to and extending perpendicularly from the shaft and a gripping portion extending perpendicularly from the leg portion so as to be parallel to and spaced from the shaft.

6. A method of securing a Christmas tree in a tree stand, the tree having a trunk with a lower end, the stand including a base constructed of a thin planar plate and having spaced apart upright brackets mounted thereon, the brackets each having an aperture therein, and a tubular receptacle mounted on the base, the receptacle having a sidewall and a bottom wall so as to be capable of holding water, the receptacle also having a pair of shafts fixedly connected to and extending horizontally from the opposite sides thereof, the shafts being pivotally received in the respective apertures of the brackets so as to support the receptacle for pivotal movement about a horizontal axis, the stand also including a lock lever associated with at least one of the brackets for releasably but securely locking the receptacle in position so that the tree is substantially vertically oriented, and a single threadable securement means to secure the tree in the receptacle, the method comprising:

inserting the lower end of the tree trunk into the receptacle so as to rest upon the bottom wall thereof;

forcing the trunk into engagement with a sidewall of the receptacle using the single threaded securement means such that the tree is secured within the receptacle.

7. The method of claim 6 wherein the tree trunk is forced into engagement with the receptacle sidewall by turning a single shaft threadably extending through the sidewall of the receptacle.

8. The method of claim 6 further comprising deactuating the lock lever to pivot the receptacle to a desired position and actuating the lock lever to lock the receptacle in the desired position.

* * * * *